US008662931B2

(12) United States Patent
Healey et al.

(10) Patent No.: US 8,662,931 B2
(45) **Date of Patent: *Mar. 4, 2014**

(54) DELAYED CONTACT ACTION CONNECTOR

(75) Inventors: H. John Healey, Apex, NC (US); Emanuele F. Lopergolo, Marlboro, NY (US); Prabjit Singh, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/540,522

(22) Filed: Jul. 2, 2012

(65) Prior Publication Data

US 2013/0023160 A1 Jan. 24, 2013

Related U.S. Application Data

(63) Continuation of application No. 12/563,351, filed on Sep. 21, 2009, now Pat. No. 8,282,420.

(51) Int. Cl.
*H01R 24/00* (2011.01)

(52) U.S. Cl.
USPC ..... 439/629; 439/188

(58) Field of Classification Search
CPC ..... H01R 4/48
USPC ..... 439/629
See application file for complete search history.

(56) References Cited

U.S. PATENT DOCUMENTS

| | | | | | |
|---|---|---|---|---|---|
| 2,946,036 | A | * | 7/1960 | Bettencourt | 439/441 |
| 3,040,291 | A | * | 6/1962 | Schweitzer et al. | 439/637 |
| 3,407,379 | A | * | 10/1968 | Nakazawa et al. | 439/637 |
| 3,422,394 | A | | 1/1969 | Antes | 339/176 |
| 3,611,259 | A | | 10/1971 | Palecek | 339/74 |
| 3,853,379 | A | | 12/1974 | Goodman et al. | 339/75 |
| 3,899,234 | A | | 8/1975 | Yeager et al. | 339/74 |
| 4,087,151 | A | | 5/1978 | Robert et al. | 439/188 |
| 4,106,841 | A | | 8/1978 | Vladic | 391/76 M |
| 4,119,357 | A | | 10/1978 | Bonhomme | 39/17 L |
| 4,476,400 | A | * | 10/1984 | Jo et al. | 307/147 |
| 4,514,030 | A | | 4/1985 | Triner et al. | 439/188 |
| 4,550,959 | A | | 11/1985 | Grabbe et al. | 439/33 |
| 4,996,766 | A | | 3/1991 | Piorunneck et al. | 29/842 |
| 5,098,306 | A | | 3/1992 | Noschese et al. | 439/188 |

(Continued)

FOREIGN PATENT DOCUMENTS

| | | |
|---|---|---|
| EP | 0 802 584 B1 | 10/1997 |
| FR | 1 391 864 A | 3/1965 |
| GB | 1 517 636 A | 7/1978 |

*Primary Examiner* — Michael Zarroli

(74) *Attorney, Agent, or Firm* — Dennis Jung; Ido Tuchman

(57) ABSTRACT

A method for using a connector with terminals for connecting to a circuit card. The connector includes a socket having a casing with an aperture for receiving the circuit card therein and electrically conductive terminals. The terminals include an elongated portion and a substantially L-shaped portion joined together by a U-shaped portion. The elongated portion has a proximal end and a distal end, and includes a support section and a bending section between the proximal end and the distal end. The U-shaped portion is disposed at the distal end of the elongated portion. The terminal continues from the U-shaped portion to approximately halfway towards the proximal end of the elongated portion and turns away from the elongated portion thereby forming the substantially L-shaped portion. The L-shaped portion ends in a lip section curving towards the proximal end of the elongated portion.

8 Claims, 6 Drawing Sheets

(56) References Cited

U.S. PATENT DOCUMENTS

| | | | | | |
|---|---|---|---|---|---|
| 5,239,748 | A | | 8/1993 | Hamilton | 29/843 |
| 5,286,215 | A | | 2/1994 | Dewey et al. | 439/188 |
| 5,316,486 | A | * | 5/1994 | Tanaka et al. | 439/62 |
| 5,366,382 | A | | 11/1994 | Thumma | 439/188 |
| 5,421,738 | A | * | 6/1995 | Roberts | 439/260 |
| 5,480,316 | A | | 1/1996 | Kinross et al. | 439/326 |
| 5,971,806 | A | * | 10/1999 | Evans et al. | 439/632 |
| 6,007,389 | A | | 12/1999 | Weber | 439/857 |
| 6,416,342 | B2 | | 7/2002 | Matsumura | 439/267 |
| 6,644,995 | B1 | | 11/2003 | Jones et al. | 439/260 |

* cited by examiner

DELAYED CONTACT ACTION CONNECTOR

CROSS-REFERENCE TO RELATED APPLICATIONS

This application is a continuation of and claims priority under 35 U.S.C. §120 to U.S. patent application Ser. No. 12/563,351 ("DELAYED CONTACT ACTION CONNECTOR") filed Sep. 21, 2009.

FIELD OF INVENTION

The present invention relates to electrical connectors, and more specifically, to a card edge connector with delayed contact action.

BACKGROUND OR RELATED ART

Typically, a card-edge connector is formed of a plurality of opposing gold-plated electrically conducting terminals. One end of each of the terminals is often fixedly attached to a casing of the connector and an opposite end of each of the contacts is bent or bowed and arranged within a slot of the casing such that a card edge may be received in the slot between the ends of opposed terminals. The bent or bowed terminals are generally configured in a spring-like fashion so as to provide a resilient force for engaging the terminals to the card edge. The card edge is typically beveled, but it is often very abrasive because of exposed glass fibers. Repeated insertion and withdrawal of the card edge into the connector can result in excessive wear of the gold-plated terminals due to wiping (rubbing) action of the card edge against the contacting surfaces of the terminals. Excessive wear of the gold-plated terminals can create debris which may prevent proper contact of the card edge and the terminal and may debilitate the spring action of the connector.

It is known in the art to provide zero insertion force (ZIF) connectors, in which the terminals are removed from the card edge path during card insertion to thereby prevent the wear of the gold-plated terminals. ZIF connectors, however, generally require a cam actuating mechanism for retracting the terminals away from the card edge path during insertion and/or for returning the terminals to an engaging position to engage the contacts with the card edge.

SUMMARY

In view of the foregoing problems and other considerations, in one embodiment of the present invention, a connector having specifically designed terminals with delayed contact action is disclosed. The connector allows repeated connecting action between a card edge and electrically conducting terminals without the terminals rubbing against the card edge and without the use of any cam actuating mechanisms for retracting the terminals. In other embodiments, the connector may allow repeated connecting action between other electronic components (e.g., a cord plug) and the electrically conducting terminals with similar advantages.

In one embodiment, a connector for connecting to a circuit card and a method thereof are disclosed. The connector generally includes a socket having a casing with an aperture for receiving the circuit card therein and a plurality of terminals made of electrically conductive material. At least one of the plurality of terminals includes an elongated portion and a substantially L-shaped portion joined together by a U-shaped portion. The elongated portion has a proximal end and a distal end, and includes a support section and a bending section between the proximal end and the distal end. The terminal is secured to the casing by the support section at or near the proximal end of the elongated portion. The U-shaped portion is disposed at the distal end of the elongated portion. The terminal continues from the U-shaped portion to a region approximately halfway towards the proximal end of the elongated portion and turns away from the elongated portion thereby forming the substantially L-shaped portion. The L-shaped portion ends in a lip section curving towards the proximal end of the elongated portion.

Preferably, the U-shaped portion and the L-shaped portion are stiffer than the bending section of the elongated portion. To that end, the width and/or the thickness of the bending section is made smaller than the width and/or thickness of the U-shaped portion.

Other embodiments and advantages thereof may be readily inferred by those of ordinary skill in the art, by reading the detailed description of the disclosure in reference to the attached drawings.

DETAILED DESCRIPTION

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification and claims, specify the presence of stated features, integers, steps, operations, elements, and/or components, but do not preclude the presence or addition of one or more other features, integers, steps, operations, elements, components, and/or groups thereof.

Figure 1:
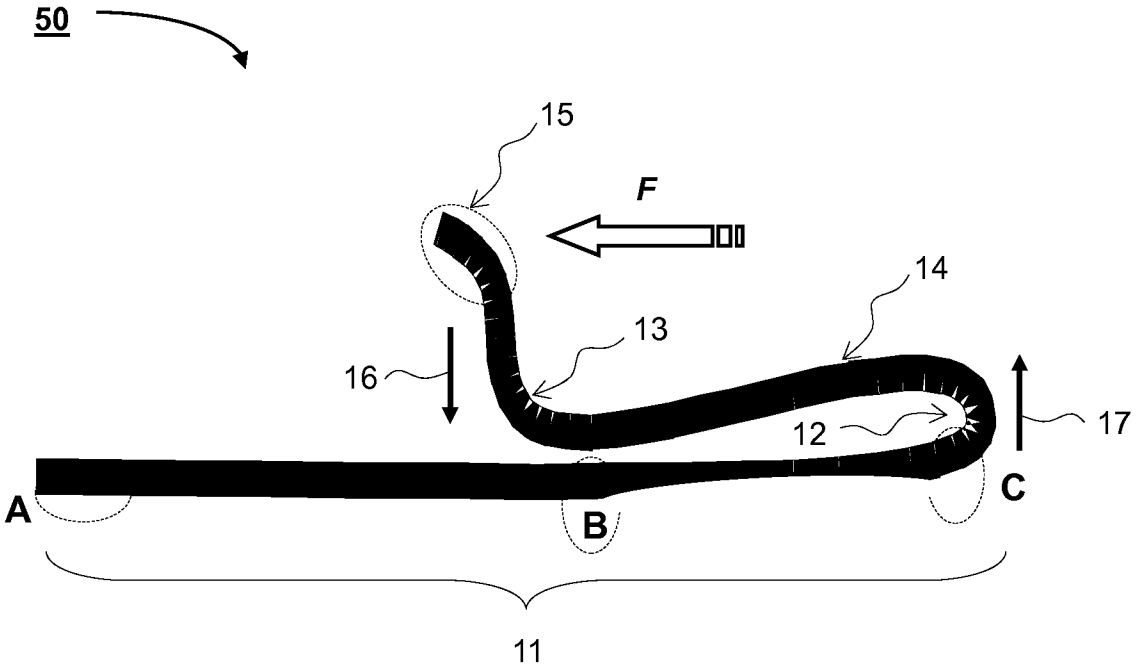
FIG. 1 shows an example of an electric terminal for a connector.

In the following description, reference is made to the accompanying drawings where like reference numerals refer to like parts throughout the disclosure. FIG. 1 shows an example of an electric terminal 50 for a connector 100 (shown in FIG. 2A) in accordance with one embodiment of the invention. Preferably, electrical terminal 50 is formed from a specifically shaped piece of electrically conductive material having an elongated portion 11 and a substantially L-shaped portion 13 joined together by a U-shaped portion 12. The elongated portion 11 extends from a distal end C to a proximal end A in a lengthwise direction of terminal 50. A supporting section A-B and a bending section B-C are contained between the proximal end A and the distal end C. At the distal end C of the elongated portion 11, terminal 50 is curved backwards towards the proximal end A such that the U-shaped portion 12 is formed therein. At substantially midway from distal end C towards proximal end A, the terminal 50 sharply turns away from the elongated portion 11 substantially orthogonally to the lengthwise direction, thereby forming the L-shaped portion therein. More specifically, continuing from the U-shaped portion 12, the L-shaped portion 13 extends at an acute angle in the direction of the elongated portion 11 and forms therein a delayed contact surface 14. The L-shaped portion 13 ends at a lip section 15 (lip) curving in the direction of the proximal end A of the elongated portion 11. A surface of the lip section 15 serves as a first contact surface for receiving a force F applied thereto in the lengthwise direction.

The supporting section A-B serves to securely mount the terminal 50 to, for example, a casing 120 of connector 100 (shown in FIG. 2A) at or near the proximal end A. The bending section B-C serves to resiliently bend the terminal 50 between an engaged position and a non-engaged position, in response to receiving the force F in the lengthwise direction. More specifically, upon receiving a force F on the lip section 15 in the lengthwise direction acting towards the proximal end A of elongated portion 11, the L-shaped portion 13 preferably moves in a first direction 16, and the bending section B-C of the elongated portion 11 preferably moves in a second direction 17, such that a delayed contact surface 14 also moves in the second direction 17. The second direction 17 is preferably opposite to the first direction 16, and both directions 16 and 17 are substantially perpendicular to the lengthwise direction of the terminal.

The above describe action of terminal 50 in response to force F acting on the lip section 15 is based on the premise that the U-shaped portion 12 and the L-shaped portion 13 are preferably stiffer than the bending section B-C of elongated portion 11. One option for achieving such an effect may be to build terminal 50 such that the width and/or thickness of U-shaped portion 12 and the L-shaped portion 13 are preferably greater than the width and/or thickness of the bending section B-C of elongated portion 11. Alternatively, or in addition thereto, it is preferable that the bending section B-C of terminal 50 be naturally biased in the direction of bending (e.g., biased in the second direction 17 in FIG. 1). Other design or material features may also achieve the preferred bending effect as set forth above. For example, bending section B-C may be fabricated of a first material that may facilitate bending whereas U-shaped portion 12 and the L-shaped portion 13 may be fabricated of a second material that would render these portions stiffer. It is, in any case, preferable that U-shaped portion 12 and the L-shaped portion 13 be stiffer than bending section B-C.

Figure 2A:
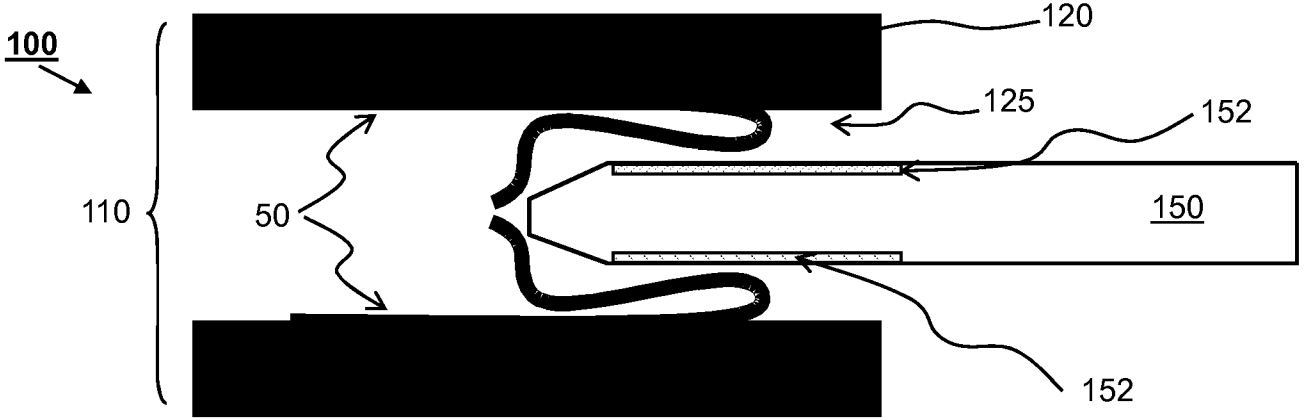
FIG. 2A shows an example of a connector having a plurality of terminals in the process of being connected to a circuit card. The circuit card is partially inserted into the connector in a non-engaged position.

FIG. 2A shows connector 100 in the process of being connected to a circuit card 150. In FIG. 2A, the card 150 is partially inserted into connector 100, but it has not yet engaged terminals 50. Thus, for purposes of this specification, FIG. 2A schematically illustrates a non-engaged position. The connector 100 includes a socket 110 having a casing 120 with an aperture 125 for receiving the circuit card 150 therein. Casing 120 fixedly secures supporting sections A-B of opposing first and second terminals 50, which are disposed within aperture 125 substantially as a mirror symmetry of each other. Each of first and second terminals 50 includes an elongated portion 11, a U-shaped portion 12 and an L-shaped portion 13, as described above in reference to FIG. 1. In the non-engaged position of FIG. 2A, terminal 50 is biased away from a position in which the terminal 50 engages a surface pad 152 of a card 150. When card 150 is inserted into aperture 125, a beveled edge of card 150 initially contacts the first contact surfaces of lip section 15 of the opposing terminals 50. At this time, the delayed contact surface 14 does not make contact with the card's contact surface 152. Instead, when a force F (representing the insertion action of card 150 into the connector) acts on the first contact surfaces of the lip section 15, the L-shaped portion moves away from the center of aperture 125 (in the first direction) substantially perpendicular to the direction of the force F, and the bending section B-C of terminal 50 bends towards the center of aperture 125 (in the second direction) also substantially perpendicular to the direction of the force F. When the bending section B-C bends in response to the force F generated by the insertion of card 150, the delayed contact surface 14 advances in the second direction towards the center of aperture 125. As the card 150 is further inserted, the lip sections 15 of the L-shaped sections 13 move away from each other so that card 150 slides on the first contact surface of lip section 15 of terminal 150 without experiencing significant abrasion or scratches. As a result, excessive wear and deterioration of the terminal 50 can be effectively prevented.

Figure 2B:
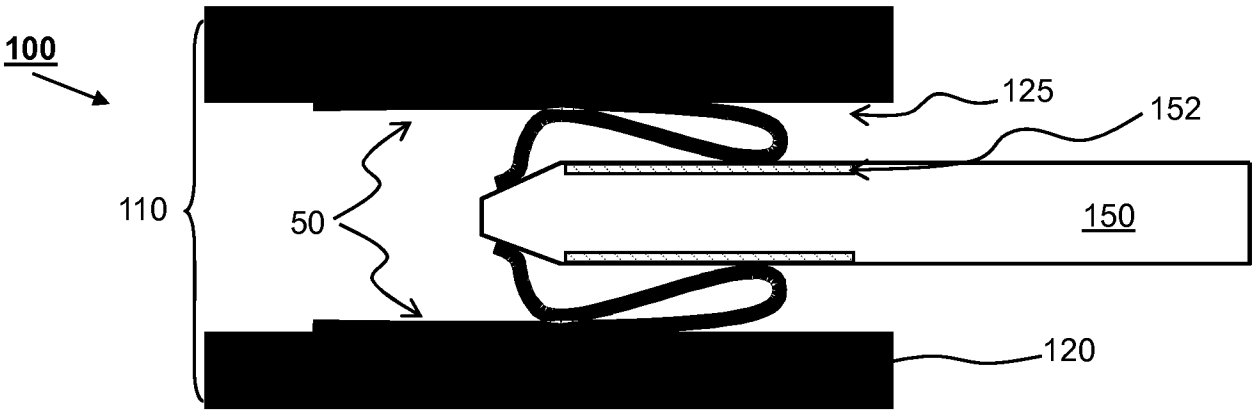
FIG. 2B shows the connector of FIG. 2A in a partially engaged position.

FIG. 2B shows a partially engaged position of connector 100 being connected to the circuit card 150. Specifically, as card 150 is further inserted into connector 100, the edge of card 150 slides on the first contact surface without experiencing significant abrasion or scratches and advances towards the proximal end A. As the edge of card 150 advances, the L-shaped portion 13 is pushed (moves) towards casing 120 (in the first direction), and the bending section B-C of terminal 50 moves away from casing 120 (in the second direction) such that the delayed contact surface 14 urges against the card's contact surface 152 (e.g., contact pads), thus making the desired electrical connection with adequate contact force. In addition, as the delayed contact surface 14 urges against the card's contact surface 152 and card 150 advances in the direction towards proximal end A, a wiping action is effected on the card's contact surface 152 so as to remove contaminants and/or debris such as dust or the like. In this manner, better contact between the card's contact pads and the terminal is provided. The wiping action as described above is advantageous in that a more reliable contact between the card and the terminal is obtained in spite of dust or debris, as compared to ZIF connectors which do not offer such a wiping action. Moreover, it should be noted that due to the specific design of the lip section 15 that curves in the direction of the proximal end A, the electrical contact 50 comfortably clears the card edge of card 150 without any rubbing against the card edge.

Figure 2C:
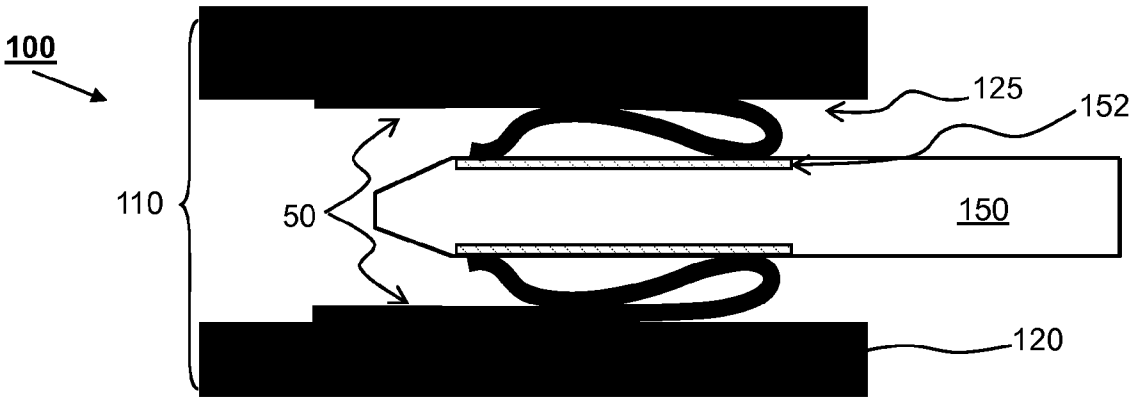
FIG. 2C shows the connector of FIG. 2A in a fully engaged position.

FIG. 2C illustrates a fully engaged position of connector 100 connected to circuit card 150. When the card 150 is fully inserted into connector 100, the lip section 15 curving in the direction of the proximal end A may, in one embodiment, also be urged against the card's contact surface 152. This configuration of the first contact surface of lip section 15 and the delayed contact surface 14 results in redundant points of contact between terminal 50 and the card's contact surface 152. Providing redundant points of contact between terminal 50 and the card's contact surface 152 helps ensure that the desired electrical contact is obtained. One example of redundancy may be foreseen in an instance where the delayed contact surface 14 fails to properly urge against the card's contact surface 152, but the urging of the first contact surface of lip section 15 against the card's contact surface 152 ensures that the desired electrical contact is still established.

Figure 2D:
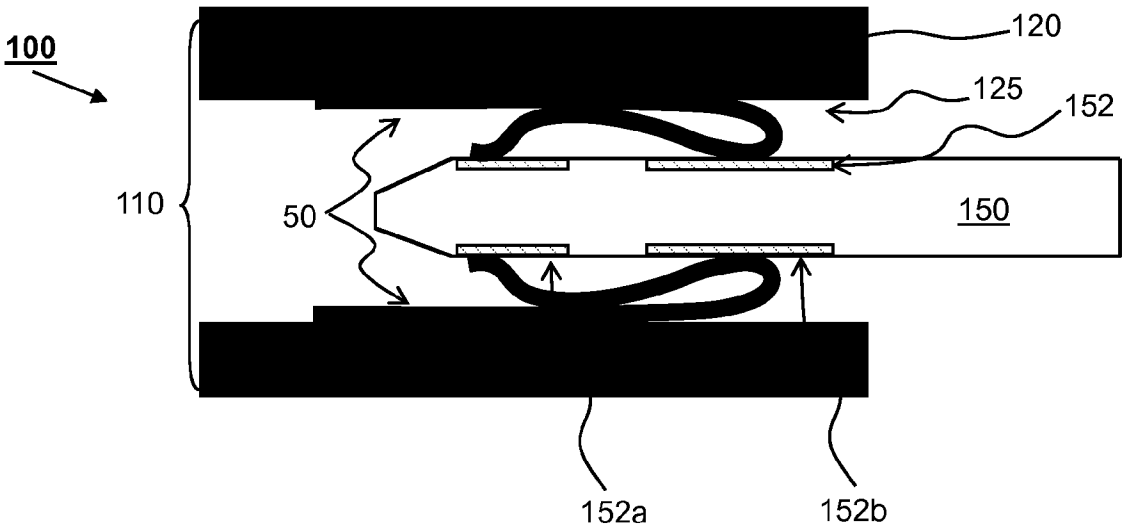
FIG. 2D illustrates the connector of FIG. 2A fully engaged to a circuit card with redundant points of contact.

FIG. 2C illustrates an alternative arrangement where multiple points of contact between terminal 50 and circuit card 150 advantageous. According to FIG. 2D, the card's contact surface 152 may be split into two contact sections: a first pad section 152*a* corresponding to the first contact surface of lip section 15 and a second pad section 152*b* corresponding to the delayed contact surface 14. In such an arrangement, the desired electrical connection may be established only when both pad contact sections are properly connected, thereby ensuring that card 150 is fully engaged. In a case where only one pad contact section of circuit card 150 is connected to terminal 50, a signal may be generated to indicate that circuit card 150 has been improperly connected. As a result, electrical malfunction and/or damage of connecting components caused by improper and/or incomplete connections are alerted and prevented.

When the card 150 is removed from its engaged position (e.g., when the card 150 is removed from connector 100) the bending section B-C moves back to the position shown in FIG. 2A, thereby causing that opposing terminals 50 return to their non-engaged position.

In the foregoing description of FIGS. 2A and 2B, it has been considered that connector 100 includes opposing first and second terminals 50 disposed within aperture 125 substantially as a mirror symmetry of each other. That is, in connector 100, the first terminal 50 is configured to engage a first surface 152 of card 150 and the second terminal 50 is configured to engage a second surface 152 of the circuit card when the circuit card is inserted into the connector. In such an arrangement, the first terminal 50 and the second terminal 50 are preferably configured to transmit different electrical signals to the circuit card 150 when the circuit card is inserted into the connector. In other arrangements, however, the first and the second terminals 50 may be configured to transmit the same electrical signal to the circuit card 150, for example, for purposes of redundancy. In addition, it is noted that connector 100 may not necessarily include opposing first and second terminals 50. Indeed, in some arrangements, it may be desirable that connector 100 include first and second terminals 50 disposed on only one side of aperture 125. An arrangement in which a connector with first and second terminals 50 (a plurality of terminals) disposed on only one side may be desirable, for example, where circuit card 150 represents a single in-line memory module (SIMM) or a singly in-line package (SIP) electronic device (a device that contains only one row of connection pins). In yet other arrangements, connector 100 may include a single terminal 50 as the first terminal and a flat terminal as a second terminal. In such a case, only the first terminal 50 may be configured to resiliently engage a contact surface 152 of card 150. Alternatively, a connector with a first terminal 50 and second flat terminal may be configured to engage, for example, a connecting pin instead of a circuit card.

Figure 3:
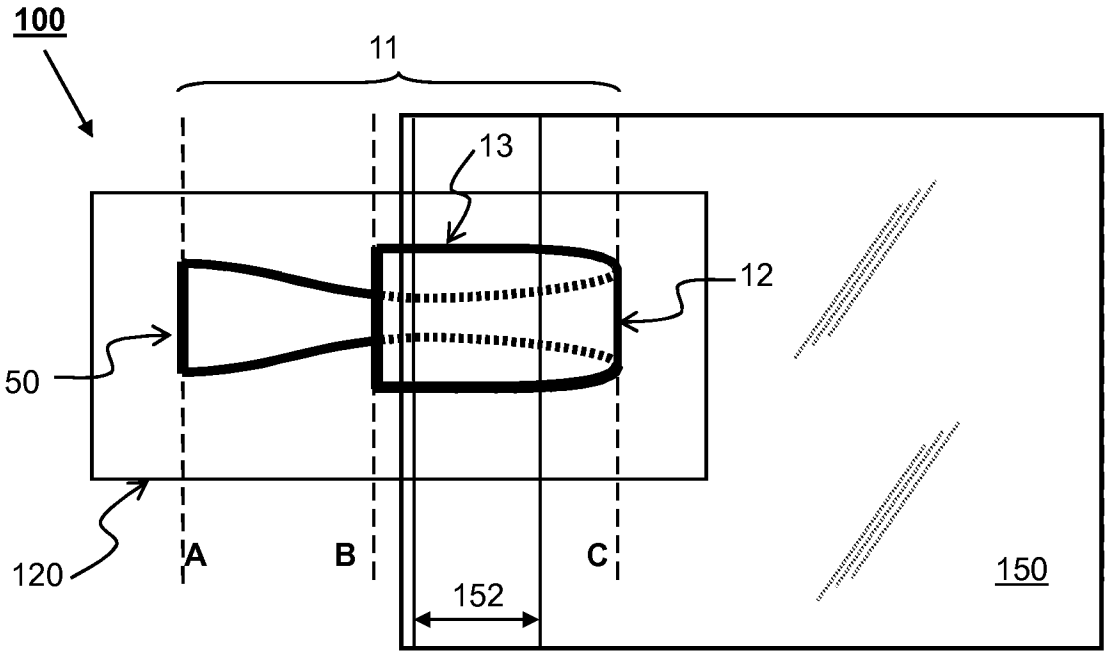
FIG. 3 shows a top view of a connector having first and second terminals 50 (only one shown) with the circuit card partially inserted therein.

FIG. 3 shows a top view of connector 100 having first and second terminals 50 (only one shown) with circuit card 150 partially inserted therein. Specifically, as illustrated in FIG. 3, the width of the terminal 50 is shaped so that the bending section B-C (shown in dashed lines) contained between the distal end C and the proximal end A of the elongated portion 11 is controlled to give the desired resilient contact force. In particular, the U-shaped portion 12 and L-shaped portion 13 are made stiffer than the bending section B-C of the elongated portion 11. As more fully discussed above in reference to FIG. 1, one option for achieving such a bending effect in terminal 50 may be to build terminal 50 such that the width and/or thickness of U-shaped portion 12 and the L-shaped portion 13 are preferably greater than the width and/or thickness of the bending section B-C of elongated portion 11. Terminal 50 may be fabricated from flat or round stock of electrically conductive material and at least the first and delayed contacting surfaces may be preferably plated with gold and/or other highly conductive materials. When using round stock (e.g., cylindrical rods), the terminal pitch may be preferably very tight (i.e., adjacent terminals are very close to each other) so at to enable a high density of multiple terminals for each contact pad to thereby provide more than two contact points between the contact pad and multiple terminals. When using flat stock (e.g., flat strips), on the other hand, the width of the first and delayed contacting surfaces is preferably made as wide as the width of the contact pad to thereby provide at least two contact points between the contact pad and a terminal.

Figure 4:
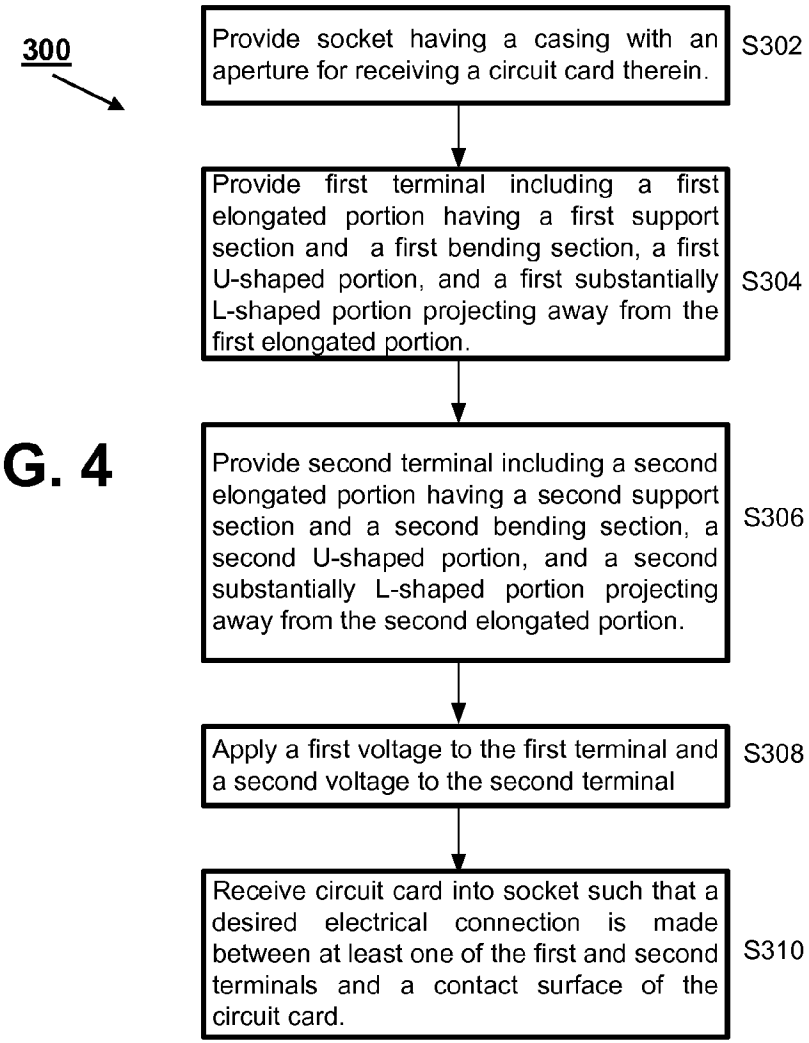
FIG. 4 shows a flowchart illustrating example method steps for connecting a connector having first and second terminals to a circuit card, as contemplated by at least one embodiment of the present invention.

FIG. 4 shows a flowchart 300 illustrating example method steps for electrically connecting a connector having first and second terminals 50 to a circuit card 150, as contemplated by at least one embodiment of the present invention. The method starts at step S302 by providing a socket having a casing with an aperture for receiving the circuit card therein. At steps S304 and S306, first and second terminals (a plurality of terminals) are provided, respectively in each of steps S304 and S306. Preferably, each of the first and second terminals includes an elongated portion having a proximal end and a distal end; the elongated portion includes a support section and a bending section between the proximal end and the distal end. Each terminal is fixedly secured to the casing of the socket by the support section at or near the proximal end. Each terminal also includes a U-shaped portion at the distal end; the U-shaped portion extends towards the proximal end for a predetermined distance and then curves to a substantially L-shaped portion projecting away from the elongated portion. The L-shaped portion ends in a lip section curving in the direction of the proximal end of the elongated portion. The lip section serves as a first contact surface for receiving a force F applied thereto representing the insertion of the circuit card in a lengthwise direction. When the circuit card is inserted into the connector, each terminal is preferably configured to resiliently bend at the bending section between an engaged position and a non-engaged position. More specifically, upon receiving the force F acting on the lip section, the L-shaped portion preferably moves in a first direction perpendicular to the lengthwise direction, and the bending section moves in a second direction opposite to the first direction such that a delayed contact surface urges against a connecting surface (e.g., contact pad) of the circuit card.

Returning to flowchart 300, the process advances to step S308. At step S308 appropriate voltage levels are applied to each of the first and second terminals. Specifically, at step S308, a first voltage may be applied to the first terminal, while a second voltage that is different from the first voltage may be applied to the second terminal. Thus, each terminal serves, for example, to conduct a different electrical signal. Alternatively, the same voltage can be applied to both of the first and second terminals. Providing the same voltage to the first and second terminals, for example, provides redundancy in the connection of electrical signals and ensures prevention of faulty connections between the connector and the circuit card (or any other electrical component).

At step S310, the connector receives the circuit card inserted therein. The receiving of the circuit card into the socket of the connector is preferably performed in a manner that allows for ensuring that a desired electrical connection has been made between at least one of the first and second terminals and a contact surface of the circuit card. Preferably multiple points of connection are desirable between the at least one of the first and second terminals and the contact surface (e.g. a contact pad) of the circuit card. Specifically, as illustrated in FIG. 2C, when card 150 is fully inserted into connector 100, the L-shaped portion 13 (shown in FIG. 1) moves towards casing 120 (in the first direction) and becomes slightly flattened out, thereby further urging the terminal against the contact surface 152. As a result, each of the terminals 50 provides at least two contact points between the card's contact surface 152 and the terminal. As discussed above, multiple points of contact are advantageous in that they offer redundancy and ensure reliable contact.

Figure 5:
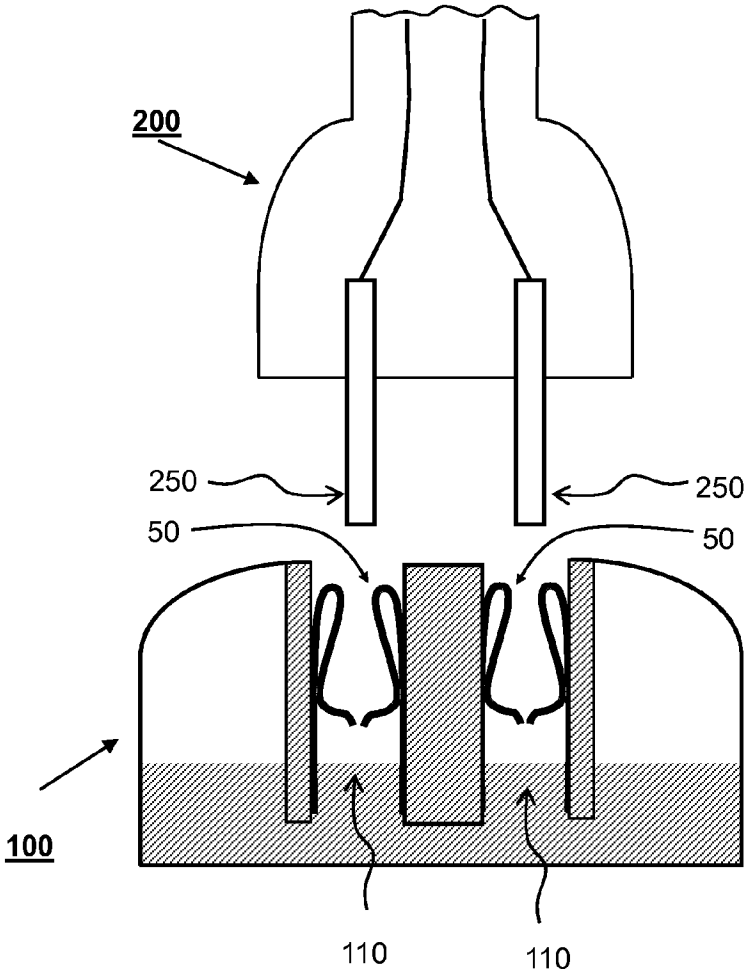
FIG. 5 shows an alternative example of a connector having a plurality of terminals for to connecting electronic components other than a circuit card.

The exemplary embodiments of the present invention have been described as a connector having first and second terminals configured to connect to a circuit card. It is to be understood, however, that the specific design of terminal 50 shall not be limited to the connection of a circuit card per se. FIG. 5 shows an alternative example of connector 100 having a plurality of terminals 50 for connecting electronic components other than a circuit card. In FIG. 5, circuit card 150 (shown in FIG. 2A) may be replaced, for example, by a plug 200 having a plurality of connecting pins 250. In such embodiment, each of the connecting pins 250 may be configured to have the function of card 150 (described in FIGS. 2A and 2B), and connector 100 may preferably include a plurality of sockets 110 each of which may include first and second terminals 50. The process of connecting connector 100 to plug 200 may be envisioned as substantially similar to that shown and described in reference to FIGS. 2A to 2B and/or FIG. 4. Specifically, in FIG. 5, it is preferable that a first contact between connecting pins 250 and terminals 50 occurs at the lip section 15 (at the end of the L-shaped portion) of terminal 50, and as the connecting pins 250 travel further into connector 100, the bending section B-C of terminal 50 bends causes that a delayed contact (second contact) occurs between the contact surface 14 and a contact surface of contact pins 250. In this manner, connector 100 can advantageously provide a redundant connection with a plurality of contact points between connector 100 and cord plug 200. As discussed supra, helping ensure that a desired electrical connection has been made is achieved by providing, among other things, a plurality of contact points between at least one of the first and second terminals and a contact surface of any electronic component (e.g., a circuit card 150 or connecting pins 250).

In the foregoing description, a connector is advantageously configured with a specifically designed electrical terminal that is shaped to clear the card edge to avoid any abrasion of the plating on the contact surface of the terminal and then to bend appropriately to make a desired connection to the card contact pad. Since there is little to no abrasion of the terminal plating, little to no metallic debris is produced that could have detrimental effect on hardware reliability. Thus, at least one embodiment of the present invention advantageously improves the state of the conventionally known card edge connectors. The new connector design can allow repeated connector plugging without the connector plating having to rub against the abrasive card edge.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The foregoing embodiments and examples were chosen and described in order to best explain the principles of the invention and the practical application, and to enable others of ordinary skill in the art to understand the invention for various embodiments with various modifications as are suited to the particular use contemplated.

What is claimed is:

1. A connector for connecting electronic components, the connector comprising:

a socket having a casing with an aperture for receiving an electronic component therein; and a plurality of terminals made of electrically conductive material, at least one of said plurality of terminals including an elongated portion having a proximal end and a distal end, the elongated portion including a support section and a bending section between the proximal end and the distal end, the at least one terminal secured to the casing by the support section at or near the proximal end, and including a U-shaped portion at the distal end and continuing to a substantially L-shaped portion projecting away from the elongated portion, the L-shaped portion including a delayed contact surface between the U-shaped portion and a region where the L-shaped portion projects away from the elongated portion, the L-shaped portion ending in a lip section curving towards the proximal end of the elongated portion a surface of the lip section serving as a first contact surface configured to receive an edge of the electronic component traveling in a lengthwise direction of the terminal, wherein the L-shaped portion is configured to move in a first direction and the bending section is configured move in a second direction substantially opposite to the first direction to an engaged position such that the delayed contact surface engages a contact surface of the electronic component, in response to the electronic component being inserted into the connector.

2. The connector of claim 1, wherein the first and second directions are substantially perpendicular to the lengthwise direction.

3. The connector of claim 1, wherein the terminal has a predetermined shape such that U-shaped portion and the L-shaped portion are stiffer than the bending section of the elongated portion.

4. The connector of claim 3, wherein at least one of a thickness and width of the bending section is smaller than a thickness and width of the U-shaped portion.

5. The connector of claim 4, wherein the plurality of terminals are arranged in two parallel, spaced apart rows such that each terminal in one row is a mirror symmetry of a corresponding terminal in a row parallel to the one row.

6. The connector of claim 4, wherein the plurality of terminals are arranged in a single row next to each other.

7. The connector of claim 3, wherein the delayed contact surface is configured to wipe the contact surface of the electronic component while the electronic component is being inserted into the connector.

8. The connector of claim 3, wherein the at least one terminal is configured to establish multiple points of contact between the terminal and the contact surface of the electronic component.

* * * * *